United States Patent [19]

Price

[11] 4,395,946

[45] Aug. 2, 1983

[54] ROTARY PRINTING PRESSES WITH INPLACE LASER IMPRESSION OF PRINTING SURFACE

[75] Inventor: Benjamin W. J. Price, Haywards Heath, England

[73] Assignee: Crosfield Electronics Limited, London, England

[21] Appl. No.: 298,408

[22] Filed: Sep. 1, 1981

[30] Foreign Application Priority Data

Sep. 3, 1980 [GB] United Kingdom ..... 8028367

[51] Int. Cl.[3] ..... B41F 9/02; B41M 1/10; B41M 5/00

[52] U.S. Cl. ..... 101/152; 101/170; 101/174; 101/211; 101/471; 101/456; 101/457; 101/401.1; 346/76 L

[58] Field of Search ..... 101/153, 152, 170, 171, 101/211, 471, 463.1, 174, 401.1, DIG. 13; 346/76 L; 430/307

[56] References Cited

U.S. PATENT DOCUMENTS 3,698,006 10/1972 Ovshinsky ..... 101/DIG. 13

FOREIGN PATENT DOCUMENTS 1229243 4/1971 United Kingdom ..... 101/170
2034636 6/1980 United Kingdom ..... 101/471

OTHER PUBLICATIONS

"Seen at IFRA EXPO", Printing Trades Journal, Dec. 1977, pp. 4, 12–18, 20.
"Laser Engraving of Gravure Cylinders", Jordan, Package Printing Diecutting, Mar. 1978, pp. 32–33.

*Primary Examiner*—E. H. Eickholt
*Attorney, Agent, or Firm*—Sughrue, Mion, Zinn, Macpeak and Seas

[57] ABSTRACT

A rotary printing press includes a laser beam imaging device to enable a rotary printing member to be prepared while it is located in the printing press. This arrangement has particular advantages when it is used with a lithographic or a gravure printing press and especially when used as a proofing press for color lithography or color gravure.

12 Claims, 5 Drawing Figures

ROTARY PRINTING PRESSES WITH INPLACE LASER IMPRESSION OF PRINTING SURFACE

In the past rotary printing members have always been prepared on a machine which is completely independent from a printing press on which prints are prepared from the printing members. After their preparation the printing members are transferred from the preparing machine to the printing press. Rotary printing members are heavy and somewhat cumbersome to handle whilst, at the same time their outer surfaces are delicate and any scratches or knocks that are received on their outer surfaces are likely to result in print defects in a print taken from the members.

According to a first aspect of the invention a rotary printing press includes a laser beam imaging device to enable a rotary printing member to be prepared whilst it is located in the printing press.

The inclusion of a laser beam imaging device in a printing press avoids the need for handling the printing members between their preparation and a printing step. Another advantage of including a laser beam imaging device on a printing press is that means to vary the position of the printing member with respect to the remainder of the press are not required. Normally, some means have to be provided to enable the printing member to be moved both axially and in the circumferential direction to ensure that the printed image is located in the required position with respect to the printing substrate. It is also normal to provide some means to enable the angular orientation of the printing member to be changed and this can also be omitted. A further advantage is that the size of the printing member is no longer critical. Normally the printing member has to be made to a very precise size in one machine to enable it to fit a different printing press.

With a press in accordance with this invention the orientation and location of the printing member with respect to the remainder of the printing press and hence the location of the print on the substrate is arranged simply by producing the image on the printing member in the required location using the laser beam imaging device. When the image is prepared in the correct place the printing member does not have to be removed or shifted in position before printing from it and consequently, provided the image is prepared in the correct place the subsequent alignment and registration is also correct.

A further advantage of including a laser beam imaging device in a printing press is that a common mounting and drive for the rotary printing member is used both whilst it is being prepared and whilst printing from it. The mounting of a rotary printing member is expensive since its bearings have to be machined accurately and its drive is also complex, particularly its timing arrangements and so this avoids a duplication and leads to a saving in cost.

The present invention is capable of use with any type of rotary press but it has particular advantages when it is used with a lithographic or a gravure printing press and especially when used as a proofing press for colour lithography or colour gravure.

Typically, for full colour printing, there are four separate colour impressions overlaid one on top of another. In a four colour process the different impressions are made with black, yellow, cyan and magenta colour inks. Typical lithographic and gravure printing presses are very large and four presses are arranged in series one downstream of the other with an ink drying station provided downstream from each press to ensure that the ink on the substrate from that press is dry before the substrate reaches the next press. Such presses are fed by a continuous web of substrate and means are provided to keep the various printing presses in synchronism with one another so that the impressions from successive printing machines are registered one on top of the other. A considerable effort is involved in the preparation of the printing members, in their initial setting up and in the setting up of the presses to ensure that the impressions printed by each press are in exact registration with one another.

Nowadays, the image which is to be printed is usually scanned by an electronic scanner and is encoded into the form of a stream of digital data. It is possible to operate on this data to enlarge or reduce the size of the image, to apply colour corrections, and to vary the page layout. A set of printing members is then prepared directly from this data after it has been operated upon. Thus, the complete set of printing members has to be prepared without any initial visual inspection or proofing step. In view of the difficulty and expense of preparing such a set of printing members and the difficulty of setting up a conventional colour press, it is desirable to be able to proof the digital data to ensure that it is correct and to ensure that it meets with the approval of the customer before undertaking the preparation of the set of printing members and undertaking the complete setting up of a conventional colour printing press.

Thus, in accordance with a second aspect of this invention a gravure colour printing press includes a cylindrical printing cylinder, an impression cylinder including means to hold a sheet of substrate to be printed, at least two inking assemblies each of which includes a doctor blade movable towards and away from the printing cylinder, and a laser beam engraving device for engraving an image on the cylindrical printing cylinder, the arrangement of the press being such that, in use, engravings corresponding to at least two colour separations of the same image are engraved around the cylindrical printing cylinder using the laser beam engraving device and then, subsequently, each inking assembly applies ink only to its corresponding engraved colour separation and each doctor blade contacts only its corresponding engraved colour separation, the substrate being held in a fixed position on the impression cylinder until it has been contacted and printed by all of the different engraved colour separations.

This arrangement provides a particularly convenient and simple gravure proofing press for enabling a visual proof to be obtained from a stream of data and whilst the press in accordance with the second aspect of the invention is useful for printing limited print runs its principal use is as a proofing press for proofing a stream of data which, after being proofed, can subsequently be used to prepare other gravure printing members for use in a large scale web-fed gravure press.

Preferably of course the printing press is arranged to engrave four different colour separations around the periphery of the printing cylinder and include four separate inking assemblies so that the press can carry out a full four colour gravure printing process. Even when the four colour separations of a single image are engraved around the periphery of the same printing cylinder it is still straightforward to arrange for the separations between the engravings corresponding to the different colour separations to be located and orientated correctly on the printing cylinder to ensure that prints from the different separations are located correctly with the substrate and in strict register with one another, without any lengthy setting up operation.

The laser beam engraving device is preferably conventional in construction and such engraving devices are described in earlier British patent specification No. 1,581,551. It is preferred that the surface of the printing cylinder which is engraved with the image and which forms the printing member is made of a plastics material. Typically, the printing member is made from a polymeric composition such as an epoxy resin or polyacetal composition and examples of these materials are described in our published British patent applications Nos. 7,931,053; 8,105,436 and 8,105,437.

In accordance with a third aspect of this invention a lithographic colour printing press includes a cylindrical printing cylinder including a plate imagible by a laser beam, an impression cylinder including means to hold a sheet of substrate to be printed, at least two inking assemblies at least the final rollers of which are movable towards and away from the printing cylinder, and a laser beam imaging device for forming an image on the plate, the arrangement of the press being such that, in use, images corresponding to at least two colour separations of the same image are imaged around the plate on the cylindrical printing cylinder using the laser beam imaging device to produce a lithographic plate and then, subsequently, each inking assembly applies ink only to its corresponding imaged colour separation, the substrate being held in a fixed position on the impression cylinder until it has been contacted and printed by all of the different colour separations on the printing cylinder.

This arrangement provides a particular convenient and simple proofing press for enabling a visual proof to be obtained from a stream of data and whilst the press in accordance with the third aspect of the invention is useful for printing limited print runs its principal use is as a proofing press for proofing a stream of data which, after being proofed, can subsequently be used to prepare other lithographic printing members for use in a large scale web-fed lithographic press.

Preferably of course, the printing press is arranged to image four different colour separations around the periphery of the printing member and include four separate inking assemblies so that the press can carry out a full four colour lithographic printing process. Even when the four colour separations of a single image are formed around the periphery of the same printing cylinder it is still straightforward to arrange for the separations between the different colour images to be located and orientated correctly to ensure that prints from the different images are located correctly on the substrate and to ensure that they are in strict register with one another.

Whilst it may be possible to include means to apply a chemical developer to the imaged lithographic plate this is not preferred. It is preferred that the lithographic plate is of a type that reuires only a physical development step such as heating or of the type that requires no development step at all.

An example of the former is the "LogE Scan process" (Registered Trade Mark) using a "lasermask" (Registered Trade Mark). In this process a transparent film coated with graphite and an organic binder is wrapped around a hydrophilic substrate. The laser beam imaging device forms an image on the surface of the transparent film and, in doing this, removes the graphite containing coating from the transparent film and deposits it on the hydrophilic substrate. When the imaging is complete the film is removed and can be used as a negative whilst heat, typically in the form of a jet of hot air, is applied to the surface of the substrate to bond the graphite and organic binder tightly onto the surface of the substrate. The areas of binder and graphite then form an oleophilic portion of the lithographic plate and the uncovered parts of the substrate the hydrophilic portions of the lithographic plate. An example of the latter type of lithographic plate is an anodised aluminium plate coated with a 2% solution of polyvinylphosphonic acid at 90° C. After exposure to an argon ion laser the irradiated areas are olephilic and non-irradiated areas are hydrophilic. Such a plate is described in British patent specification No. 1,578,591.

The printing press may include a blanket cylinder located and acting between the printing cylinder and the impression cylinder when it is required that the press operates as an offset lithographic press.

Preferably the imaging or engraving device includes an imaging or engraving head mounted on a slideway arranged parallel to the axis of the printing cylinder and movable along the slideway by a leadscrew drive mechanism. The head of the laser imaging or engraving device is moved along the slideway whilst the printing cylinder is rotated so that the head describes a helical path over the surface of the printing cylinder. The drive for the leadscrew is preferably coupled to the rotary drive of the printing cylinder so that the movement of the head in the axial direction of the printing cylinder is precisely controlled upon the angular rotation of the printing cylinder. The peripheral speed of both the impression cylinder and the printing cylinder must be substantially the same and, when the printing cylinder carries four printing members, it is preferred that the length of the periphery of the printing cylinder is at least four times as great as that of the impression cylinder. In this case, the impression cylinder must rotate at an angular speed at least four times that of the printing cylinder. The impression cylinder, the printing cylinder and the leadscrew of the engraving head may be connected together through a mechanical gear train and, for example, the inking assemblies may be linked to the printing cylinder through a mechanical coupling including a cam and a cam follower arranged so that at least part of the inking assemblies move towards and away from the printing cylinder during each rotation of the printing cylinder. With the press arranged in this way, the operation of the entire press is synchronised and driven from a single mechanical drive.

However, it is preferred that all the various parts of the press include an independent drive and then their operation is synchronised by an electronic control system. In this case, the printing cylinder, the impression cylinder, and the leadscrew all include angular position encoders which encode their angular positions into the form of electronic signals. A drive for moving at least part of each of the inking assemblies towards and away from the printing cylinder is then controlled in dependence upon the angular position of the printing cylinder, and the speed of the impression cylinder and the speed of the rotation of the leadscrew is controlled in dependence upon the speed of the printing cylinder by comparing the signals representing their angular positions, with these being multiplied by a scaling factor to ensure that the required ratio in their angular velocity is achieved.

The printing press preferably includes an automatic sheet feeder to feed sheets one at a time from a stack of sheets to the impression cylinder but it may include a sheet feeder which provides individual sheets from a roll or web and then feeds these to the impression cylinder.

Ink applied to the substrate from one printing member must be dry before ink from the next printing member is applied on top of it to prevent the different colour inks mixing and to prevent contamination between the differently coloured inks. It may be possible to use inks which dry or cure during a single revolution of the impression cylinder but when the press is used as a proof press it is preferred to use the same type of inks that will eventually be used in the final printing operation.

Conventional gravure inks, rely on solvent evaporation to take time to dry and thus, it is preferred that the impression cylinder and the printing cylinder are movable apart from one another to allow the impression cylinder to rotate in step with the printing cylinder but without contacting the printing cylinder so that no printing takes place. This gives the ink on the substrate held on the impression cylinder an opportunity to dry before the impression cylinder and the printing cylinder are once again brought together so that the printing member prints the next colour onto the substrate.

With the printing press arranged in this way, it is preferred that the axis of the impression cylinder is moved towards and away from that of the printing cylinder and the axis of the printing cylinder remains fixed in position. The press may also include an ink drying and cooling arrangement comprising a pair of ducts extending along the length of the impression cylinder and means to supply hot air to the upstream one of these and cold air to the downstream one.

Two examples of printing presses in accordance with this invention will now be described with reference to the accompanying drawings; in which.

Figure 1:
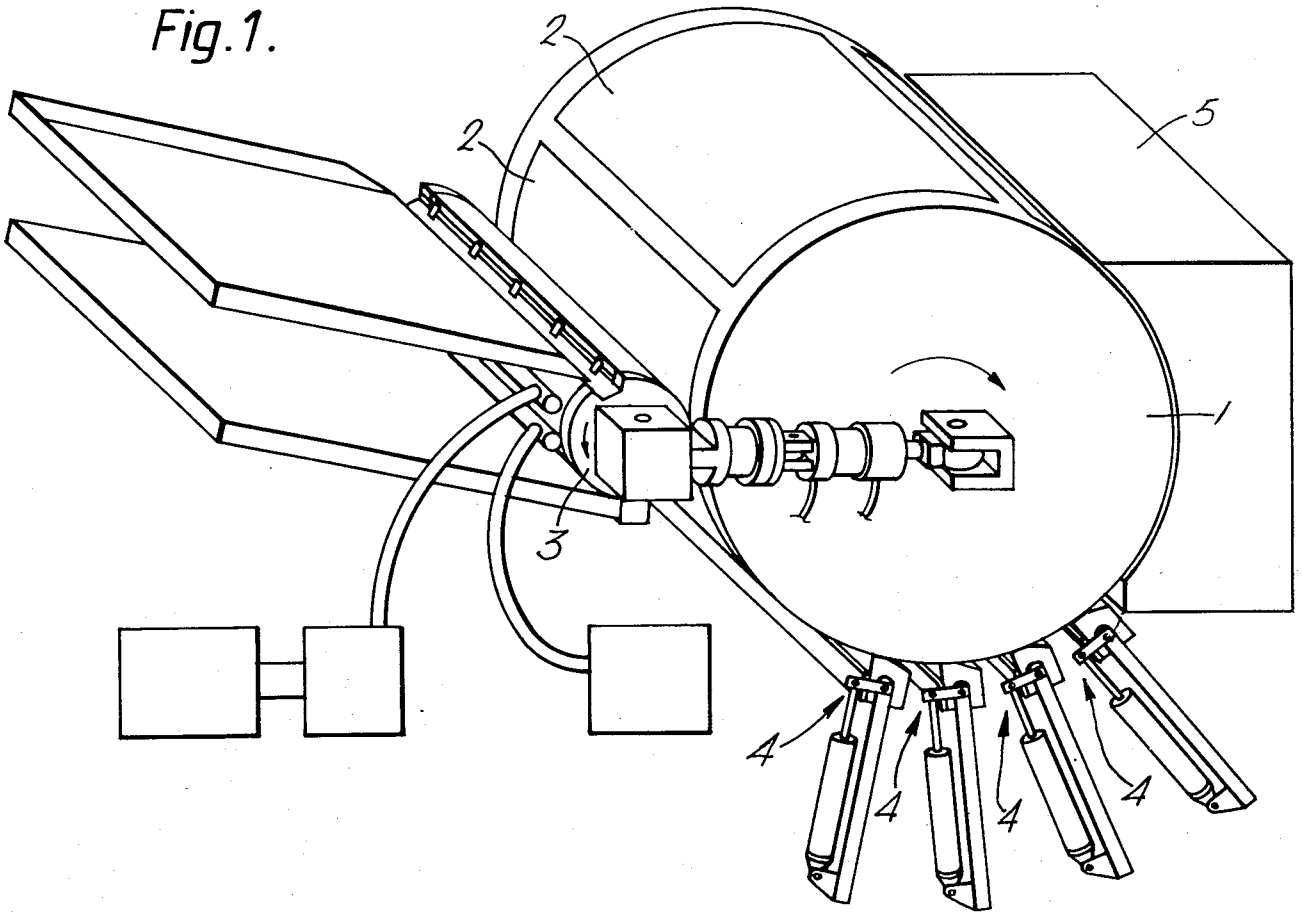
FIG. 1 is a perspective diagrammatic view of a first example of gravure press.
Figure 2:
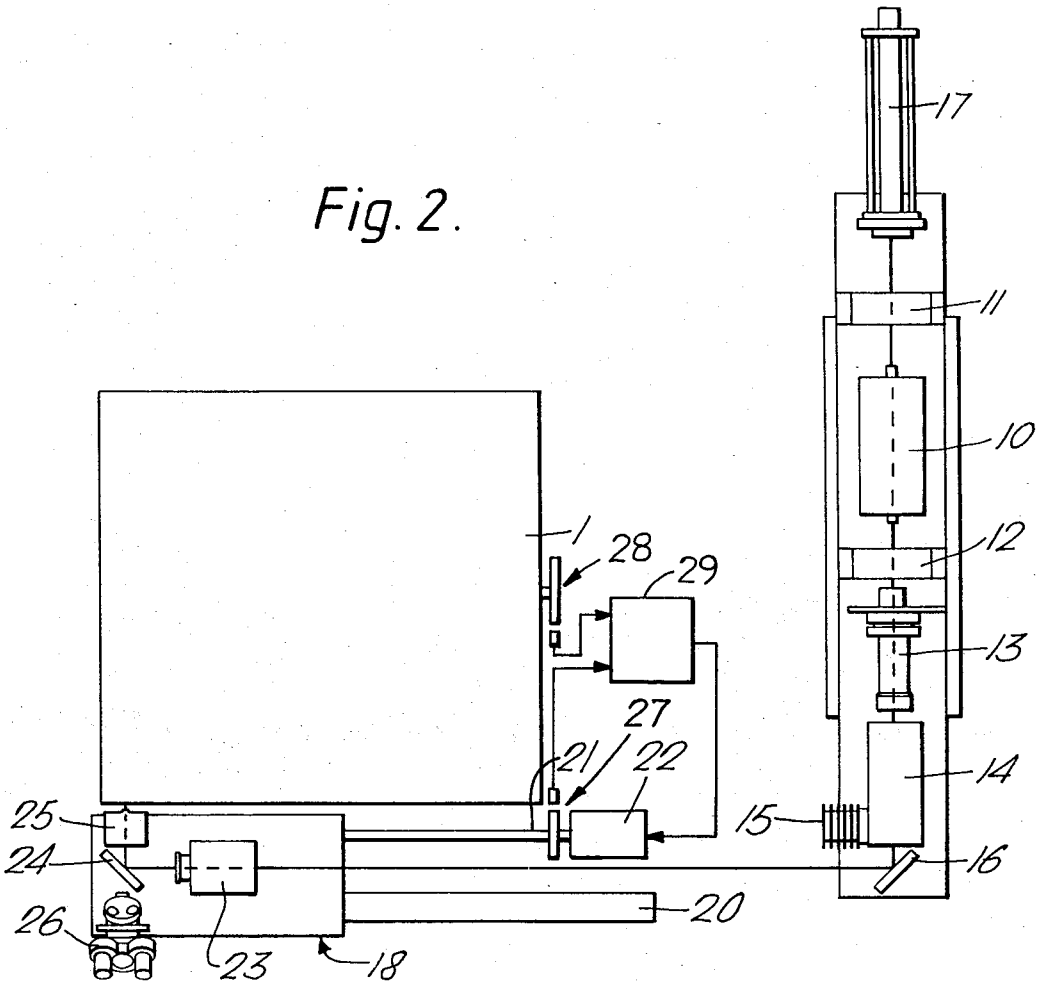
FIG. 2 is a plan of part of the press showing the laser imaging device.

The basic construction of the first example of press is substantially identical to that described in commonly assigned copending application Ser. No. 298,407 also filed on Sept. 1, 1981. Accordingly, the construction and interaction of the various parts of the press will not be described in detail in this application. This example of press comprises a printing cylinder 1 with four printing members 2 engraved into its surface, an impression cylinder 3 which is arranged to hold a sheet of paper to be printed, and four inking assemblies 4 each containing ink of a different colour and each being arranged to apply ink only to its corresponding colour separation. In addition to this the press in accordance with this invention includes a laser engraving device 5. The outer surface of the printing cylinder 1 is formed by a polymeric composition such as an epoxy resin or polyacetal composition. Printing members 2 are engraved into the surface of this polymeric composition by the laser engraving device 5.

The laser engraving device comprises a YAG-Yttrium Aluminium Garnet, laser 10 located in an optical cavity defined by mirrors 11 and 12, a beam expander 13, a modulator 14 including a beam dump 15 and a mirror 16. A further helium neon laser 17 is aligned with the YAG laser 10. This part of the laser beam engraving device is fixed in position at the side of the press. The laser beam engraving device also includes a movable engraving head mounted on a movable carriage 18 arranged to slide along a slideway 20 under the action of a leadscrew 21 driven by a motor 22. The laser engraving head includes a beam reducer 23 a mirror 24 and a focusing lens 25 which focuses the laser beam onto the surface of the printing cylinder 1. The laser engraving head also includes a binocular microscope 26. The mirror 24 is dichoric and thus, whilst the beam from the lasers 10 and 17 is reflected from the surface of the mirror 24 visible light can pass straight through the mirror 24 and so be recieved by the binocular microscope 26 to enable an operator to view the surface of the printing cylinder 1.

The leadscrew 21 includes an angular position encoder 27 which is electronically coupled to an angular position encoder 28 connected to the printing cylinder 1. The output pulses from these two angular position encoders are electronically coupled together in an electronic control system 29 to ensure that the rotation of the leadscrew 21 is coupled to that of the printing cylinder 1 and thereby ensure that the carriage 18 is moved uniformly with respect to the printing cylinder 1 so that the laser beam focused by the focusing lens 25 describes a uniform helical path over the surface of the printing member 1. The information to be engraved on the surface of the printing member 1 has the form of a string of video data and this is applied to the modulator 14 to modulate the intensity of the laser beam from the laser 10. Again the application of the string of video data is clocked by signals from the angular position encoder attached to the printing cylinder 1. The basic construction and arrangement of the laser engraving device is conventional. The helium neon laser 17 which has an output in the visible region is used during the initial setting up of the laser engraving apparatus but takes no further part in the operation of the device.

Figure 3:
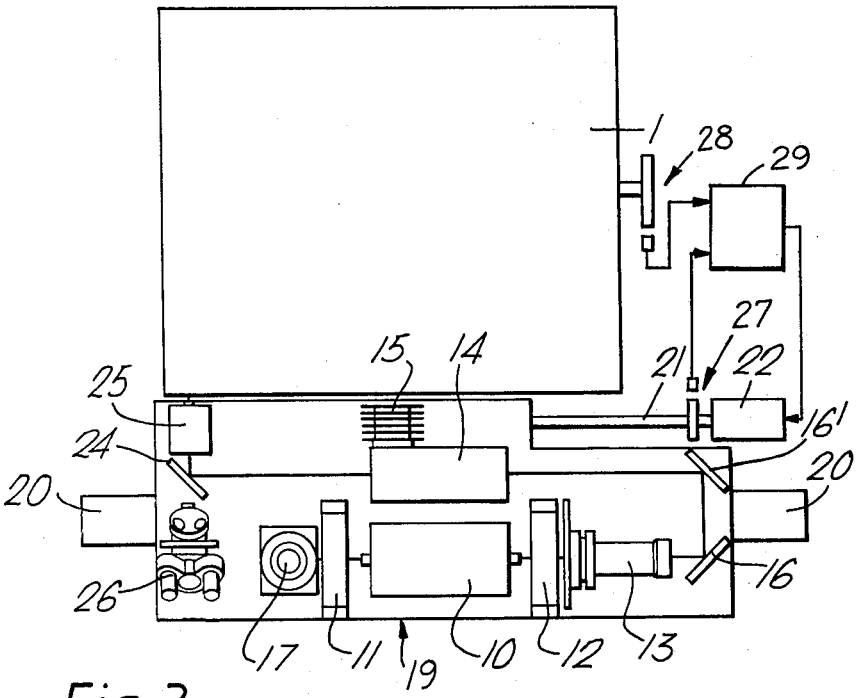
FIG. 3 is a plan of part of the press showing a modification of the laser imaging device.

In the modification of the laser engraving device 5 shown in FIG. 3 the entire laser engraving device is mounted on a carriage 19 and moves with the carriage 19 in the axial direction of the printing cylinder 1. Like parts have been given like reference numerals and the only additional feature is an additional mirror 16' to turn the laser beams through a further 90° in their passage from the lasers 10 and 17 to the focusing lens 25.

Figure 4:
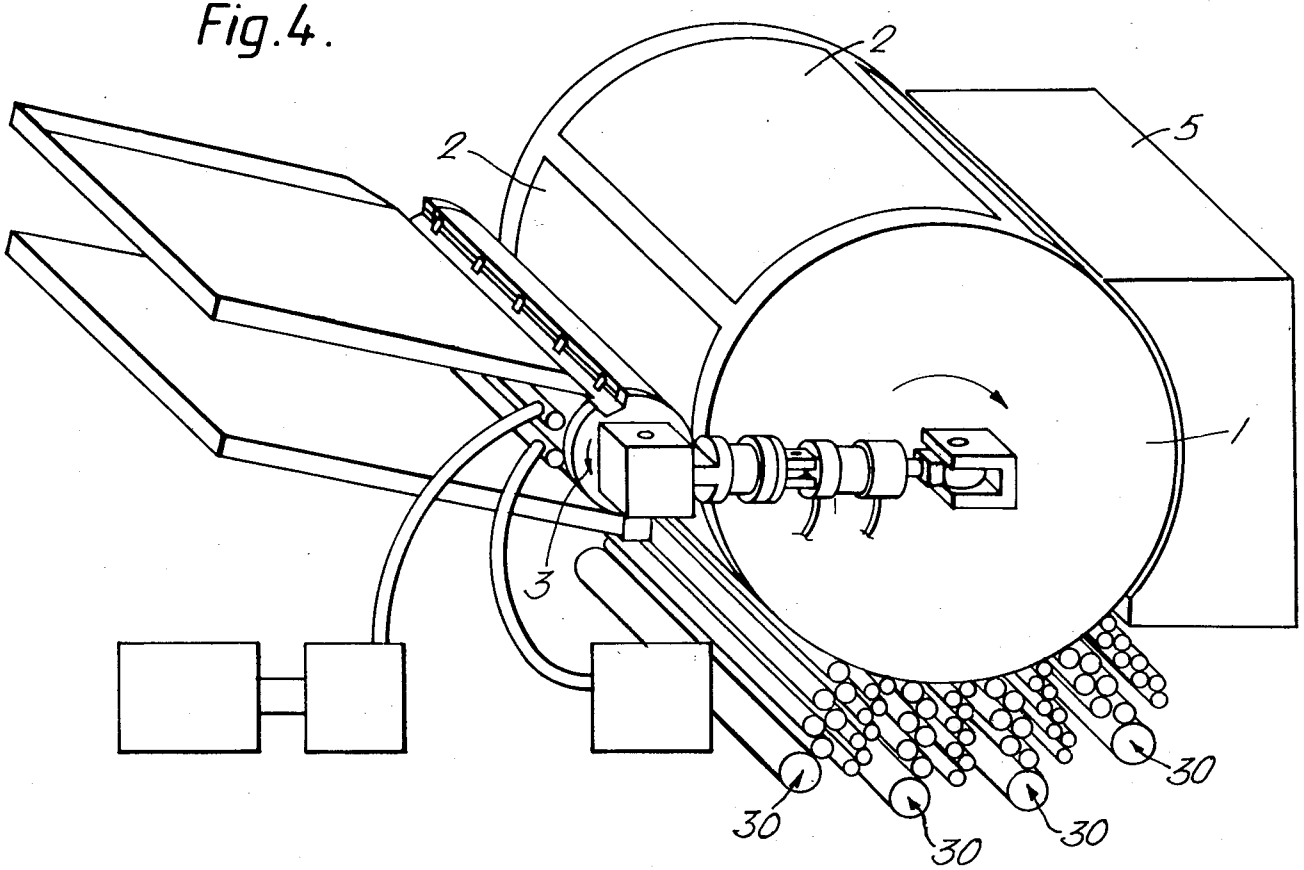
FIG. 4 is a perspective digrammatic view of a second example of a lithographic press; and, FIG. 5 is a diagrammatic side elevation of a modification of the second example.

A second example of press in accordance with this invention is shown in FIG. 4 and this example of press is a four colour lithographic press. In general, this is of similar construction to the first example save for the arrangement of the inking assemblies and equally the arrangement of the laser imaging device is generally similar to that already discussed with reference to the first example except that the YAG laser need not be as powerful. For some applications it is preferred to use an argon ion laser instead of a YAG laser but the general arrangement and construction of the laser imaging device is substantially the same as that described with reference to the first example. In this example, the principal difference is the arrangement of the inking assemblies 4, which here each comprise a set of rollers 30. Ink used in lithographic printing is thick and viscous in nature and this ink is extruded onto the lowermost roller of each set of inking rollers and then is transferred from one roller to the next to obtain a uniform inking. The final roller in the series which contacts the printing cylinder 1 is movable into and out of contact with the surface of the printing cylinder 1 by means (not shown) but which are analogous to those used in the first example. Immediately preceding each set of inking rollers 30 is a set of dampening rollers which damp the surface of the printing cylinder 1.

In use, the surface of the printing cylinder 1 is covered by a plate of hydrophilic material and this, in turn, is covered by a transparent sheet having a coating of graphite and an organic binder. This printing cylinder 1 is then rotated and the images to be printed by the printing cylinder 1 are imaged on the surface of the transparent sheet of material by the laser imaging device 5. When the laser beam impinges on the surface of the transparent film the coating containing graphite and an organic binder is transferred from the transparent film onto the surface of the plate. Once all the images 2 have been prepared, the transparent film is removed and this can act as a negative for the preparation of subsequent printing members by more conventional techniques. The surface of the printing member 2 is then heated by a jet of hot air to develop and fix the graphite and organic binder material that has been transferred from the sheet of material and this transferred coating is oleophilic in nature and thus receives ink from the sets of inking rollers 30.

To print from this lithographic plate so formed the hydrophilic areas of the lithographic plate attract water from the dampening rollers and then ink from the inking rollers is attracted to the oleophilic portions of the printing plate. Thus, each area 2 containing an image contains ink only on those parts of the image area where the coating has been transferred to the printing plate. Each set of inking rollers is arranged to contact only the image of its corresponding colour separation in an analogous fashion to the inking assembly of the first example. The printing members 2 are again printed onto a substrate held on the impression cylinder 3 in an analogous fashion to the first example.

Figure 5:
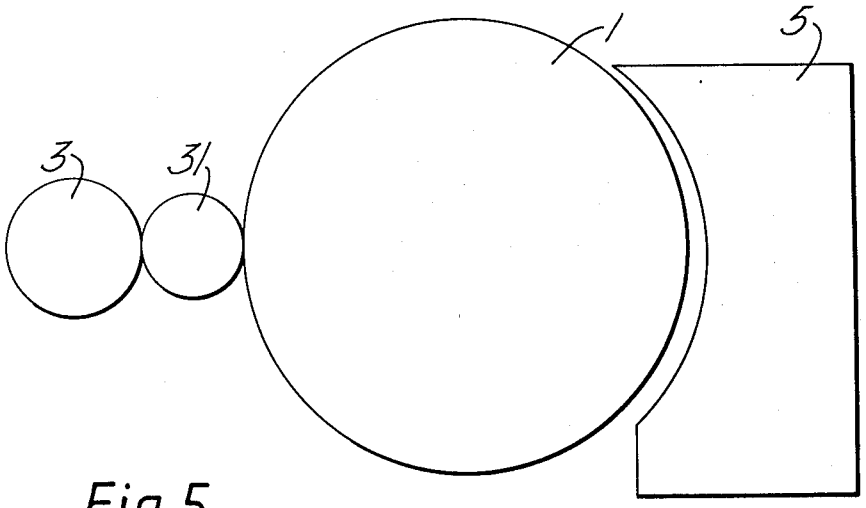

In a modification of the second example a blanket roller 31 is located inbetween the printing cylinder 1 and the impression cylinder 3 to provide an offset between the printing cylinder 1 and the impression cylinder 3. This is shown diagrammatically in FIG. 5.

I claim:

1. A rotary colour printing press, comprising:

(a) a cylindrical printing cylinder capable of carrying at least two permanent printing images corresponding to at least two different colour separations of the same image, (b) an impression cylinder, (c) means for holding a sheet of substrate to be printed on said impression cylinder, (d) at least two inking assemblies for applying liquid printing inks of at least two different colours corresponding to said different colour separations, each of said inking assemblies applying ink only to its corresponding colour separation, and (e) a laser beam imaging device operatively associated with said printing press for forming said at least two permanent printing images on said cylindrical printing cylinder while said printing cylinder is located in said printing press, said substrate being held in a fixed position on said impression cylinder until it has been contacted and printed by all of said different colour separations.

2. A gravure colour printing press including:

a cylindrical printing cylinder;

an impression cylinder;

means to hold a sheet of substrate to be printed on said impression cylinder;

at least two inking assemblies;

a doctor blade in each of said inking assemblies, each of said doctor blades being movable towards and away from said printing cylinder; and, a laser beam engraving device for engraving an image on said cylindrical printing cylinder, said press being arranged whereby engravings corresponding to at least two colour separations of the same image are engraved around said cylindrical printing cylinder using said laser beam engraving device and then, subsequently, each of said inking assemblies applies ink only to its corresponding engraved colour separation and each said doctor blade contacts only its corresponding engraved colour separation; the substrate being held in a fixed position on said impression cylinder until it has been contacted and printed by all of said different engraved colour separations.

3. The printing press of claim 2, wherein said laser engraving device includes a YAG-Yttrium Aluminium Garnet, laser.

4. The printing press of claim 2, wherein said laser beam engraving device includes an engraving head; a slideway arranged parallel to said printing cylinder, said engraving head being mounted on and movable along said slideway; and, a leadscrew drive mechanism for moving said engraving head along said slideway.

5. The printing press of claim 4, wherein said drive for said leadscrew is coupled to a rotary drive of said printing cylinder whereby said movement of said engraving head in the axial direction of said printing cylinder is precisely controlled upon the angular rotation of said printing cylinder.

6. The press of claim 5, wherein all the movable parts of said press include independent drive means; which also includes an electronic control system to synchronise the operation of the independent drive means, angular position encoders associated with said printing cylinder and said leadscrew, said angular position encoders encoding the angular position of said printing cylinder and said leadscrew into the form of electronic signals, and wherein said electronic control system controls the rotation of said leadscrew in dependence upon the rotation of said printing cylinder by comparing said signals representing their angular positions.

7. A lithographic colour printing press including:

a cylindrical printing cylinder;

a lithographic plate imagible by a laser beam;

an impression cylinder;

means to hold a sheet of substrate to be printed on said impression cylinder;

at least two inking assemblies;

final ink applying rollers of said inking assemblies being movable towards and away from said printing cylinder;

a laser beam imaging device for forming an image on said lithographic plate, said press being arranged whereby images corresponding to at least two colour separations of the same image are imaged around said lithographic plate on said cylindrical printing cylinder using said laser beam imaging device to produce a lithographic plate and then, subsequently, each of said inking assemblies applies ink only to its corresponding imaged colour separation, the substrate being held in a fixed position on said impression cylinder until it has been contacted and printed by all of said different colour separations on said printing cylinder.

8. The printing press of claim 7, which also includes a blanket cylinder located and acting between said printing cylinder and said impression cylinder whereby said press operates as an offset lithographic press.

9. The printing press of claim 7, wherein said laser beam imaging device includes a YAG-Yttrium Aluminium Garnet, laser.

10. The printing press of claim 7, wherein said laser beam imaging device includes an imaging head; a slideway arranged parallel to said printing cylinder, said imaging head being mounted on and movable along said slideway; and, a leadscrew drive mechanism for moving said imaging head along said slideway.

11. The printing press of claim 10, wherein said drive for said leadscrew is coupled to a rotary drive of said printing cylinder whereby said movement of said imaging head in the axial direction of said printing cylinder is precisely controlled upon the angular rotation of said printing cylinder.

12. The press of claim 11, wherein all the movable parts of said press include independent drive means; which also includes an electronic control system to synchronise the operation of the independent drive means, angular position encoders associated with said printing cylinder and said leadscrew, said angular position encoders encoding the angular position of said printing cylinder and said leadscrew into the form of electronic signals, and wherein said electronic control system controls the rotation of said leadscrew in dependence upon the rotation of said printing cylinder by comparing said signals representing their angular positions.

* * * * *